US005641187A

United States Patent [19]

Frolov

[11] Patent Number: 5,641,187

[45] Date of Patent: Jun. 24, 1997

[54] ELECTROMAGNETIC SHEAR LOCK

[75] Inventor: George Frolov, Farmington, Conn.

[73] Assignee: Harrow Products, Inc., Grand Rapids, Mich.

[21] Appl. No.: 526,584

[22] Filed: Sep. 11, 1995

[51] Int. Cl.[6] ..... E05C 17/56

[52] U.S. Cl. ..... 292/251.5; 292/92

[58] Field of Search ..... 292/251.5, 92, 292/144, 177

[56] References Cited

U.S. PATENT DOCUMENTS

| | | | |
|---|---|---|---|
| 2,801,870 | 8/1957 | Davey | 292/251.5 |
| 2,812,965 | 11/1957 | Horvay | 292/251.5 |
| 2,904,364 | 9/1959 | Korodi | 292/251.5 |
| 4,652,028 | 3/1987 | Logan et al. | 292/251.5 |
| 4,703,962 | 11/1987 | Kelly et al. | 292/251.5 |
| 4,720,128 | 1/1988 | Logan et al. | 292/251.5 |
| 4,826,223 | 5/1989 | Geringer et al. | 292/251.5 |
| 4,840,411 | 6/1989 | Sowersby | 292/251.5 |
| 4,957,316 | 9/1990 | Frolov | 292/251.5 |
| 4,981,312 | 1/1991 | Frolov | 292/251.5 |
| 4,986,581 | 1/1991 | Geringer et al. | 292/251.5 |
| 5,000,497 | 3/1991 | Geringer et al. | 292/251.5 |
| 5,016,929 | 5/1991 | Frolov | 292/251.5 |
| 5,141,271 | 8/1992 | Geringer et al. | 292/251.5 |
| 5,184,854 | 2/1993 | Chen | 292/251.5 |
| 5,184,855 | 2/1993 | Waltz et al. | 292/251.5 |
| 5,429,399 | 7/1995 | Geringer et al. | 292/92 |
| 5,496,079 | 3/1996 | Frolov | 292/251.5 |

*Primary Examiner*—Steven N. Meyers
*Assistant Examiner*—Donald J. Lecher
*Attorney, Agent, or Firm*—Chilton, Alix & Van Kirk

[57] ABSTRACT

An electromagnetic shear lock comprising an electromagnet assembly which is mounted to a door frame and an armature assembly which is mounted to a door, the electromagnet assembly and armature assembly defining a gap. The armature assembly includes an armature mounted on a leaf spring. The electromagnet assembly includes an electromagnet which is mounted to a mounting plate. A pair of springs which engage opposite end portions of the mounting plate bias the mounting plate and electromagnet away from the armature. When the electromagnet is energized and the electromagnet and armature are attracted to each other, the mounting plate slides longitudinally along the guide member against the force of the springs and the electromagnet is displaced to close the gap.

20 Claims, 5 Drawing Sheets

ELECTROMAGNETIC SHEAR LOCK

FIELD OF THE INVENTION

This invention relates to elecctromagnetic door locks, and more particularly, to electromagnetic door locks of the type known as shear locks.

BACKGROUND OF THE INVENTION

Electromagnetic security locks are well known in which an electromagnet is mounted to one of a door frame or a door and an armature is mounted to the other. In the predominant installations of such locks, the armature and electromagnet are generally mounted so that the face of the electromagnet and armature is parallel with a plane of the door and the holding force or attractions between the electromagnet and armature is perpendicular to the door when in a closed position. Such locks are known as surface locks. An attempted forced opening of the door is resisted by the electromagnetic attraction of the armature to the electromagnet.

This type of arrangement is very effective, providing a locking force against unauthorized opening of a door. However, as is generally the case, the armature must be mounted on the vertical surface of the door, while the electromagnet is mounted from the door frame and overhangs the top edge of the door. This type of lock, while very effective from a security standpoint, is not suitable for mounting on many types of swinging or double-acting doors.

Also, in many instances, for aesthetic purposes, a better concealment of the electromagnetic lock is desirable. This has led to increased popularity of the so-called shear lock, in which the electromagnet is mounted within the door frame and an armature is mounted at or adjacent the top edge of the door and is adapted to be attracted to the electromagnet when the door is in a closed position.

This type of magnetic shear lock presents some technical problems which must be considered. Typically, such a magnetic shear lock is mounted to a door and frame such that the electromagnet must exert an upward pull on the armature wherein the armature jumps the gap between the electromagnet and the armature to achieve locking of the door. The width of the gap which may be imposed between the electromagnet and the armature of conventional electromagnetic shear locks is limited by several factors. First, the electromagnetic field produced by the armature must be sufficiently great to bridge the gap and attract the armature. Second, the armature is generally biased against such movement so the door will positively unlock when the electromagnet is deenergized. Consequently, the magnetic field must overcome the force of gravity and the biasing force which oppose movement of the armature towards the electromagnet.

Commercial and design considerations limit the strength of the magnetic field which may be produced. To be commercially competitive, the overall design of the lock system should not impose unusual interface requirements or excessive installation costs. Consequently, the size of the electromagnet assembly is limited such that it will fit within the door frame and not require the removal of additional wall material. In addition, the electromagnet power requirements are limited such that they may be satisfied by standard power supplies and electrical circuits.

Therefore, the magnetic field strength, the orientation of the electromagnet and armature assemblies, and the biasing force limit the width of the gap in conventional electromagnet shear locks.

Accordingly, the present invention provides a new and improved electromagnetic shear lock with mechanical reinforcement which provides great resistance to attempted unauthorized entry, and is of reduced cost, and further provides a new and improved electromagnet mounting arrangement which allows a greater gap width.

SUMMARY OF THE INVENTION

Briefly stated, the invention in a preferred form is an electromagnetic shear lock which comprises an electromagnet assembly which is mounted to a door frame and an armature assembly which is mounted to a door. The electromagnet is generally of E-shaped cross section with a coil wound about the middle leg and between the outer legs comprising a plurality of E-shaped laminations. Secured to either end of the stack of laminations are extension members which have end portions which project below the laminations and below the doorway soffit. The electromagnet further includes a back plate of ferrous material to provide an increased path for magnetic flux and which also acts as a structural member.

A mounting plate is mounted to the back plate. Edge portions of the mounting plate extend laterally beyond the electromagnet. Each edge portion has an orifice for slidably receiving a guide member. A first end portion of the guide member has a radially extending lip defining a shoulder. A spring disposed around the guide member engages the shoulder and a surface of the mounting plate whereby the spring biases the mounting plate towards the top of the electromagnet frame and biases the first end portion of the guide member away from the mounting plate. A second end portion of the guide member is slidably received in a blind bore in the electromagnet frame. The guide member has a stepped axial bore for receiving a threaded bolt. The stepped bore defines a shoulder which engages the bottom of the bolt head. The top of each bolt head has a socket adapted to receive a turning tool such as an Allen wrench. The distal end of each bolt threadably engages a threaded orifice in the electromagnet frame.

In the un-energized condition of the electromagnet, the spring urges the electromagnet and mounting plate away from the armature. When the electromagnet is energized and the electromagnet and armature are attracted to each other, the mounting plate slides longitudinally along the guide member against the force of the spring and the electromagnet closes the gap. The projections on the electromagnet assembly enter the notches in the armature to provide mechanical reinforcement to the lock. Such arrangement allows the use of a greater gap between the electromagnet and armature for a given magnetic field, increasing flexibility of design and installation.

The spring force on the mounting plate may be adjusted by turning the bolts, causing the guide member to either compress or decompress the spring. In an alternate embodiment, the blind bore in the electromagnet frame has a predetermined depth and the bolt is fully screwed in wherein a predetermined spring force is imposed on the mounting plate.

An object of the invention is to provide a new and improved electromagnetic shear lock which is capable of improved operational reliability.

Another object of the invention is to provide an electromagnetic shear lock which allows the use of a greater gap between the electromagnet and armature.

A further object of the invention is to provide a new and improved universal mounting for the electromagnet of an electromagnetic shear lock which may be utilized with all types of doors.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawing in which.

DETAILED DESCRIPTION OF THE PREFERRED EMBODIMENT

Figure 1:
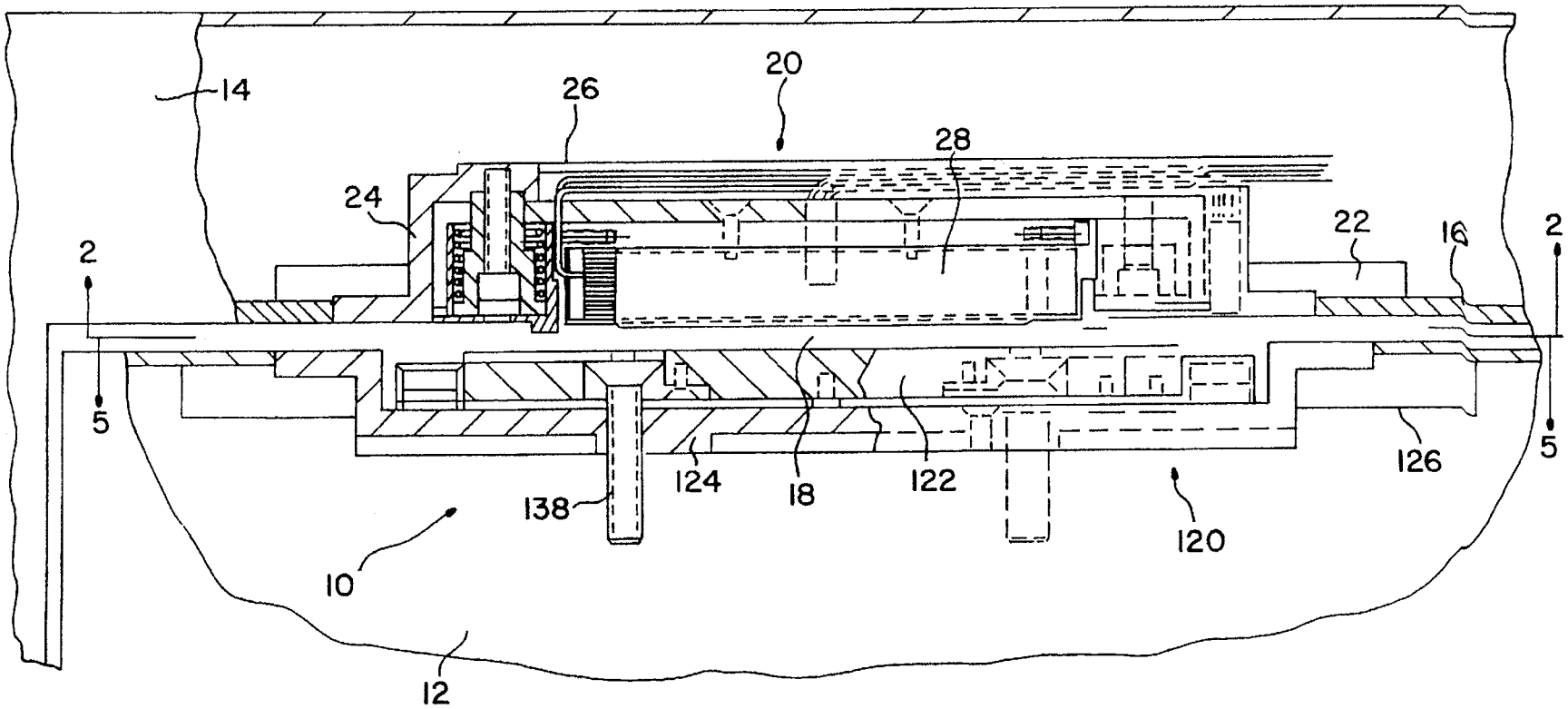
FIG. 1 is a front elevation of a portion of a door and door frame partially cut away to show the installation of an electromagnetic shear lock comprising an electromagnet and an armature embodying the invention and further cut away to show details of the construction of the electromagnet and armature.

With reference to the drawings wherein like numerals represent like parts throughout the several figures, an electromagnetic shear lock in accordance with the present invention is generally designated by the numeral 10. FIG. 1 shows a door 12 closing a doorway 14 defined by a door frame 16. The door 12, as shown, will be hinged on the right side. The door 12 and door frame 16 shown in FIG. 1 have a hollow metal configuration from which portions have been removed to define an opening into the hollow interior. The door 12 may also comprise a solid material, a metal, fiberglass, or plastic shell filled with insulating material, or other conventional construction.

In a preferred embodiment, mounting plates 22 are used to secure the electromagnet assembly 20 to the door frame. One end portion of each mounting plate 22 is fixed to a portion of the soffit of the door frame 16 by means of screws or bolts (not shown). The mounting plates 22 extend over the opening defined in the door frame. L-shaped support members 24 which form part of the non-magnetic electromagnet frame 26 are secured to the mounting plates 22 by a plurality of screws or bolts (not shown). The mounting plates 22 may have a recessed portion to receive the support members 24 and provide additional mechanical strength to the joint.

Figure 2:
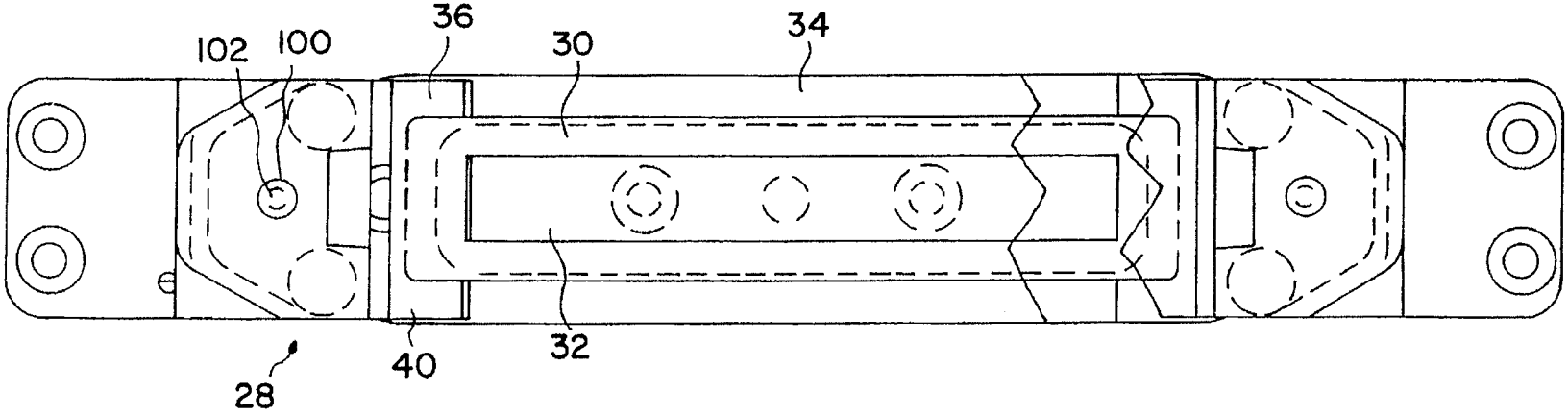
FIG. 2 is an enlarged bottom view of the electromagnet of FIG. 1 seen in the plane 2—2 of FIG. 1.

The electromagnet 28 is generally of E-shaped cross section with a coil 30 wound about the middle leg 32 and between the outer legs 34 comprising a plurality of E-shaped laminations. Secured to either end of the stack of laminations are extension members 36 which receive the end portions of the coil, as shown in FIG. 2. The extension members 36 have projections 38 on the end portions 40 which project below the laminations and below the soffit. The coil 30 for the electromagnet 28 may be potted within the E-shaped electromagnet with the potting extending into the extension members 36.

Figure 3:
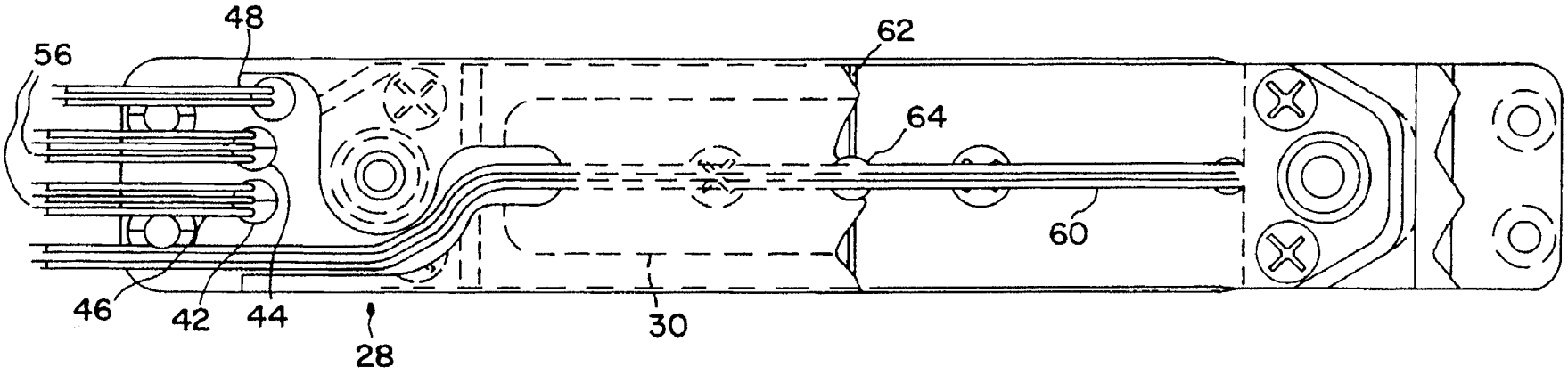
FIG. 3 is a top view, partly in cross-section and partly in phantom, of the electromagnet of FIG. 2.
Figure 4:
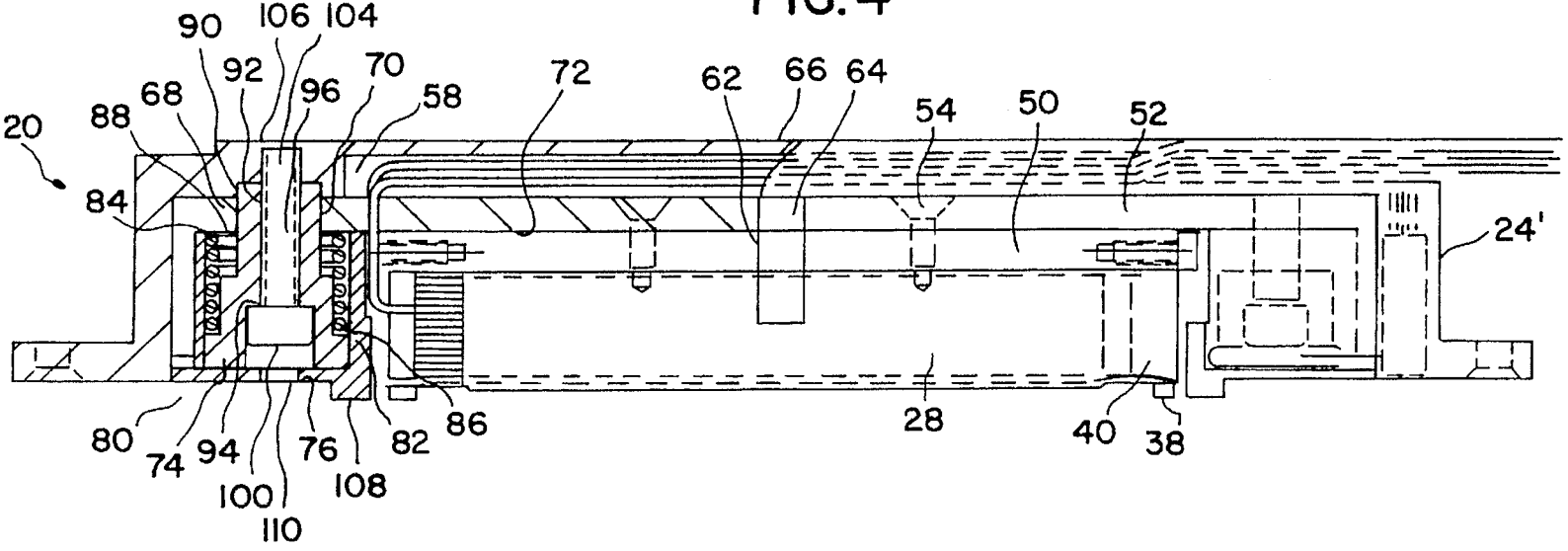
FIG. 4 is a cross-section view of the electromagnet of FIG. 2.

As shown in FIGS. 3 and 4, one of the support members 24' has first and second partial bores 42, 44 for receiving first and second reed switches 46, 48. The electromagnet further includes a back plate 50 of ferrous material to provide an increased path for magnetic flux and which also acts as a structural member. The back plate 50 is mounted to a mounting plate 52 by a plurality of bolts 54. Wires 56 lead from the first and second reed switches 46, 48 to a control module (not shown). The back plate 50 and the mounting plate 52 define a passageway 58 for wires 60 connected to the coil 30 of the electromagnet 28 for energization of the electromagnet 28. In an alternative embodiment, the middle leg 32 has a blind bore 62 for receiving a third reed switch 64. Wires 66 leading from the third reed switch 64 to the control module are also disposed in the passageway 58.

End portions 68 of the mounting plate 52 extend laterally beyond the electromagnet 28. Each end portion 68 has an orifice 70 for slidably receiving a cylindrical guide member 74. A first end portion 76 of the guide member 74 has a radially extending lip 80 defining a shoulder 82. A first end 86 of a spring 84 disposed around the guide member 74 engages the shoulder 82 and a second end 88 engages a surface 72 of the mounting plate 52 whereby the spring 84 biases the mounting plate 52 towards the top of the electromagnet frame 26 and biases the first end portion 76 of the guide member 74 away from the mounting plate 52. A second end portion 78 of the guide member 74 is slidably received in a blind bore 90 in the electromagnet frame 26. The guide member 74 has a stepped axial bore 92 for receiving a threaded bolt 96 having a head 98 and a threaded shank portion 99. The stepped bore 92 defines a shoulder 94 which engages the bottom of the bolt head 98. The top 100 of each bolt head 98 has a socket 102 adapted to receive a turning tool such as an Allen wrench. The distal end portion 104 of the shank 99 threadably engages an orifice 106 in the electromagnet frame 26. This arrangement allows the spring force to be adjusted to increase or decrease the resistance to movement of the electromagnet 28 and mounting plate 52 upon energization of the electromagnet 28. In an alternate embodiment, the blind bore 90 in the electromagnet frame 26 has a predetermined depth and the bolt 96 is fully screwed in wherein a predetermined spring force is imposed on the mounting plate 52.

Housings 108 mounted to the electromagnet frame 26 enclose each guide member 74. A slot in each housing 108 allows the mounting plate 52 to move longitudinally on the guide member 74 and an orifice 110 in the housing 108 allows access to the socket 102 in the bolt heads 98.

Figure 5:
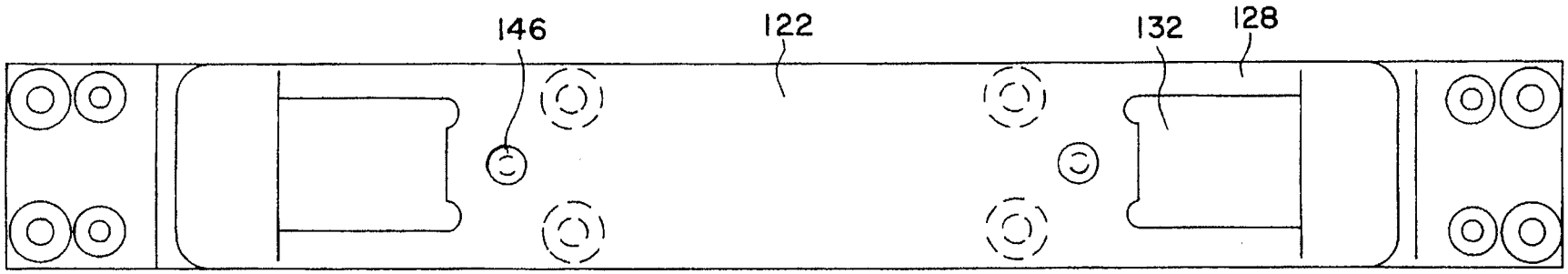
FIG. 5 is an enlarged top view of the armature of FIG. 1 seen in the plane 5—5 of FIG. 1.
Figure 6:
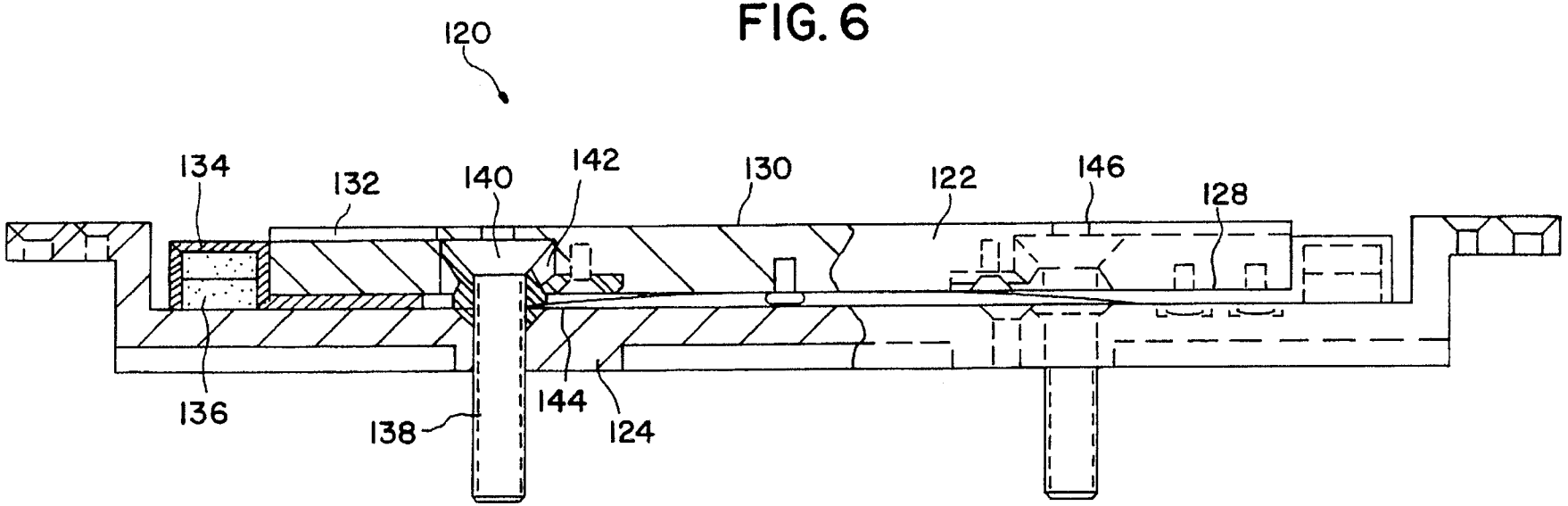
FIG. 6 is a side view, partly in cross-section and partly in phantom, of the armature of FIG. 5.

The armature assembly 120 comprises an armature 122 and a mounting or support member 124. Mounting plates 126 are used on either side of the armature assembly 120 to mount the armature assembly 120 to the door 12. As shown in FIGS. 5 and 6, the top surface 130 of each end portion 128 of the armature 122 has recesses or notches 132 cut therein. Members 134 composed of non-magnetic material are secured to each end of the armature 122 by bolts or other suitable means. Permanent magnets 136 may be housed in cavities in the members 134 to actuate the first and second reed switches 46, 48.

The mounting member 124 has two spaced apart height adjustable support members 138 shown as bolts or screws having heads 140. The heads 140 extend into recesses 142 defined in the under surface of the armature 122. Beneath each head 140 of each of the bolts 138 is a collar which bears on an end of a leaf spring 144. The middle of the leaf spring 144 is fastened to the armature 122 by means of a bolt or screw. In the un-energized condition of the electromagnet 28, as shown in FIG. 1, the armature 122 rests on the heads 140 of the bolts 138.

Figure 7:
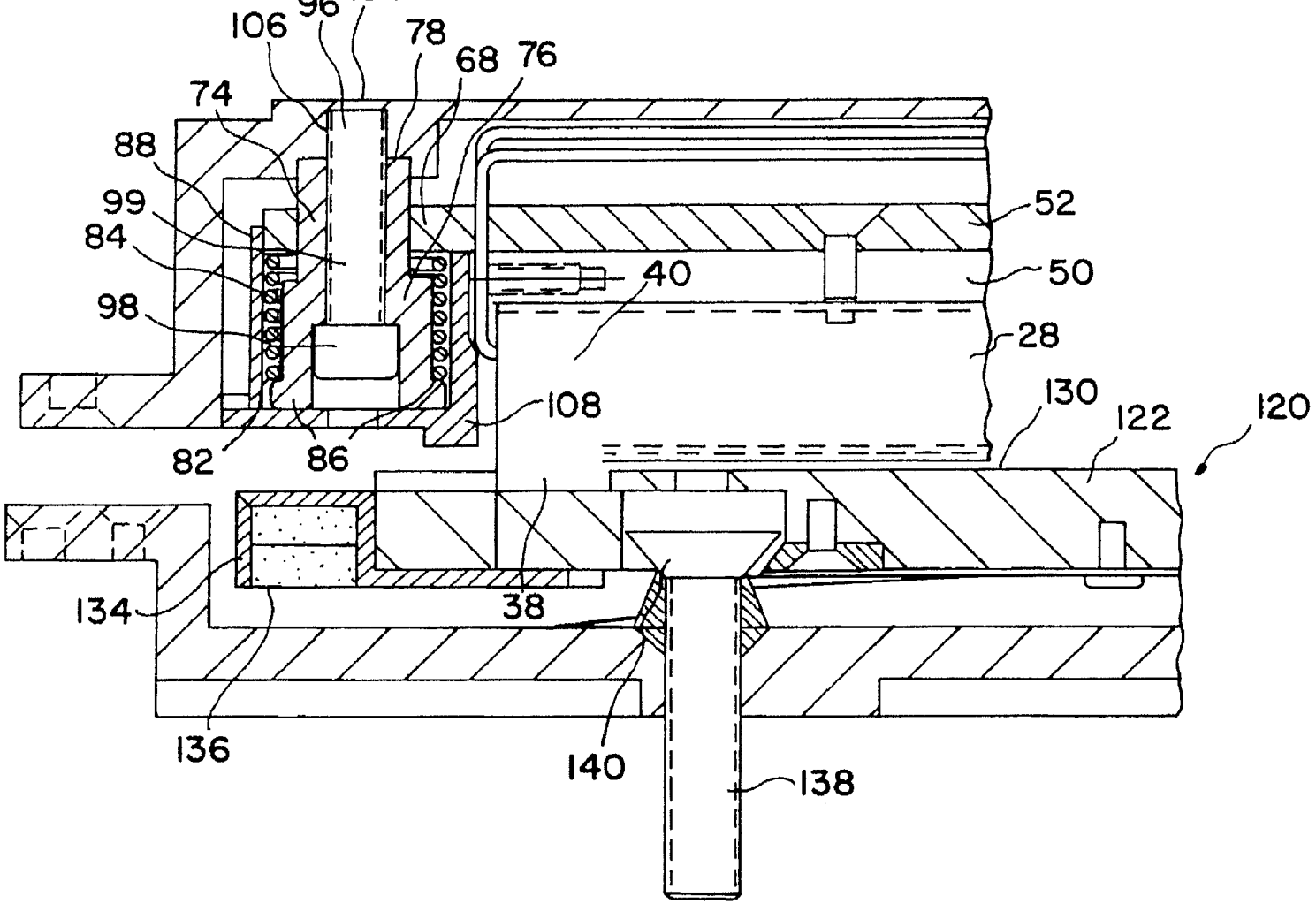
FIG. 7 is an enlarged view of a portion of the electromagnet and armature of FIG. 1 when the electromagnet is energized.

In the deenergized condition of the electromagnet 28, as shown in FIG. 1, the mounting plate 52 rests on the springs 84 to define a retracted position and a gap 18 is present between the electromagnet 28 and the armature 122. FIG. 7 exemplifies the lock assembly 10 when the electromagnet 28 is energized and the electromagnet 28 and armature 122 are attracted to each other. The spring constant of spring 84 is selected such that the magnetic force required to move the electromagnet 28 and mounting plate 52 against the force of the springs 84 is less than the force required to move the armature against the force of the leaf spring 144.

Upon energization of the electromagnet, the mounting plate 52 slides longitudinally along the guide members 74 against the force of the springs 84, and the electromagnet is displaced (normally downwardly) from the retracted position, reducing the width of the gap 18 between the electromagnet 28 and the armature 122. Reducing the gap 18 causes the magnetic field to increase. When the electromagnet 28 is close enough to the armature 122 that the magnetic field is great enough to overcome the spring force of the leaf spring 144, the armature 122 moves off the heads 140 of the bolts 138 and the leaf spring 144 is flexed, storing energy therein. At this time, the projections 38 on the electromagnet 28 enter the notches 132 in the armature 122 to provide mechanical reinforcement to the lock and the upper armature surface 130 is in contact with all three legs 32, 34 of the electromagnet 28. The engagement of the notches 132 and projections 38 provides mechanical reinforcement against unauthorized opening of the door 12 when the electromagnet 28 is energized.

When the electromagnet 28 is deenergized, the electromagnet springs 84 and the armature leaf spring 144 will return to their original condition to unlock the door. The use of a spring-mounted electromagnet 28 allows the gap 18 to be wider than that of conventional electromagnet shear locks. This provides greater flexibility in application and use. The springs 84 support the electromagnet 28 so that the electromagnet is essentially nearly weightless, and the electromagnet is readily displaced into the gap by the bonding force. By contrast, in conventional installations, the bonding force must overcome the weight of the armature and the armature spring force to bond the electromagnet and the armature. In some applications, the electromagnet 28 will cross the gap and the armature 122 will not rise off the heads 140 of the bolts 138.

Small passages 146 are defined in the armature 122 leading to the recesses and sockets in the bolt heads. The sockets are adapted to receive a turning tool such as an Allen wrench. This permits height adjustment of the bolts to align the armature with the top of the door. This arrangement also serves to permit adjustment of the space between the armature and support member for different types of doors.

The first and second reed switches 46, 48 are utilized to provide a remote indication that the door 12 is open or closed. When the door 12 is closed, the permanent magnets 136 in the armature 122 are sufficiently close to the reed switches 46, 48 to attract the reeds and activate the switch. When the door 12 is opened, the reeds return to their normal position, deactivating the switch. The third reed switch 64 is used to determine whether the magnetic field produced by the electromagnet 28 has a sufficient strength. The spring constant of the reed is selected such that a magnetic field having a strength below a predetermined level will be insufficient to attract the reed. A sufficiently powerful magnetic field will attract the reed, activating the switch.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An electromagnetic shear lock for locking a door in a doorway comprising:

an electromagnet assembly adapted to be mounted to the doorway, said electromagnet assembly comprising a frame, an electromagnet, and support means for supporting said electromagnet in said frame, said electromagnet comprising an elongated core having a pair of outer legs and a middle leg defining an E-shaped cross section with an energizing coil positioned about said middle leg of said E-shaped core and between said outer legs of said E-shaped core, said support means comprising first mounting means mounted to said electromagnet, second mounting means mounted to said frame, and biasing means for exerting a biasing force between said first and second mounting means for supporting said mounting means relative to said frame; and an armature assembly adapted to be mounted to the door in a position to be attracted to the electromagnet so that when said electromagnet is energized, said electromagnet is displaceable relative to said frame to bond with said armature assembly.

2. The lock of claim 1 wherein said first mounting means comprises first and second end portions and a mounting portion intermediate said end portions, said electromagnet being mounted to said first mounting means at said mounting portion.

3. The lock of claim 2 wherein said biasing means comprises first and second springs, each of said springs having opposite first and second ends, said first end of said first spring engaging said first end portion of said first mounting means and said first end of said second spring engaging said second end portion of said first mounting means wherein said first and second springs exert a spring force on said first mounting means.

4. The lock of claim 3 wherein said second mounting means comprises first and second guide members, said first and second guide members being disposed in said first and second springs, respectively.

5. The lock of claim 4 wherein each of said guide members has first and second end portions, each of said first end portions having a radially extending lip defining a shoulder wherein said second end of said first spring engages said shoulder of said first guide member and said second end of said second spring engages said shoulder of said second guide member.

6. The lock of claim 5 wherein said first and second end portions of said first mounting means each define an opening for slidably receiving said second end portions of said first and second guide members, respectively.

7. The lock of claim 6 wherein each of said guide members each define a stepped axial bore, said stepped axial bore defining a shoulder.

8. The lock of claim 7 wherein said second mounting means further comprises first and second bolts, each of said bolts having a head, said first bolt being disposed in said bore of said first guide member and said second bolt being disposed in said bore of said second guide member wherein said head of each bolt engages said shoulder of each bore.

9. The lock of claim 8 wherein said frame comprises first and second segments, each of said segments defining a threaded opening, and wherein each of said bolts further comprises a threaded shank, said shanks of said first and second bolts being threadably engaged with said first and second openings, respectively.

10. The lock of claim 9 wherein said head of each of said bolts further comprises socket means for receiving a turning tool wherein turning a said bolt adjusts said spring force.

11. An electromagnetic shear lock comprising an armature assembly comprising an armature and an electromagnet assembly comprising a frame, an electromagnet and support means for supporting said electromagnet in said frame, said support means comprising biasing means for biasing said electromagnet to a retracted position relative to said frame, wherein when said electromagnet is energized said electromagnet is displaceable from said retracted position and said armature and said electromagnet are magnetically bonded.

12. The lock of claim 11 wherein said support means further comprises a mounting member having first and second end portions and a mounting portion intermediate said end portions, said electromagnet being mounted to said mounting member at said mounting portion.

13. The lock of claim 12 wherein said biasing means comprises first and second springs, each of said springs having opposite first and second ends, said first end of said first spring engaging said first end portion of said mounting member and said first end of said second spring engaging said second end portion of said mounting member wherein said first and second springs exert a spring force on said mounting member whereby said mounting member is biased to said retracted position.

14. The lock of claim 13 wherein said biasing means further comprises first and second guide members, said first and second guide members being disposed in said first and second springs, respectively.

15. The lock of claim 14 wherein each of said guide members has first and second end portions, each of said first end portions having a radially extending lip defining a shoulder wherein said second end of said first spring engages said shoulder of said first guide member and said second end of said second spring engages said shoulder of said second guide member.

16. The lock of claim 15 wherein said first and second end portions of said mounting member each define an opening for slidably receiving said second end portions of said first and second guide members, respectively.

17. The lock of claim 16 wherein each of said guide members each define a stepped axial bore, said stepped axial bore defining a shoulder and wherein said biasing means further comprises first and second bolts, each of said bolts having a head, said first bolt being disposed in said bore of said first guide member and said second bolt being disposed in said bore of said second guide member wherein said head of each bolt engages said shoulder of each bore.

18. The lock of claim 17 wherein said frame comprises first and second segments, each of said segments having a surface and defining a threaded opening, and wherein each of said bolts further comprises a threaded shank, said shanks of said first and second bolts being threadably engaged with said first and second openings, respectively.

19. The lock of claim 18 wherein said head of each of said bolts further comprises socket means for receiving a turning tool wherein turning a said bolt adjusts said spring force.

20. An electromagnet shear lock assembly for locking a door in a doorway comprising:

an electromagnet assembly adapted to be mounted to the doorway, said electromagnet assembly comprising a first frame, an electromagnet, and first support means for supporting said electromagnet in said first frame, said first support means comprising first biasing means for exerting a biasing force between said first support means and said first frame; and an armature assembly adapted to be mounted to the door in a position to be attracted to the electromagnet when said electromagnet is energized, said armature assembly comprising a second frame and second support means for supporting said armature in said second frame, said second support means comprising second biasing means for exerting a biasing force between said second support means and said second frame;

wherein said electromagnet is displaceable relative to said first frame and said armature is displaceable relative to said second frame to bond said electromagnet with said armature.

* * * * *